United States Patent [19]

Beer et al.

[11] Patent Number: 4,543,348

[45] Date of Patent: Sep. 24, 1985

[54] MANUFACTURE OF ELECTRODES WITH LEAD BASE

[75] Inventors: Henri B. Beer, Heide Kalmthout, Belgium; Jean M. Hinden, Chambesy, Switzerland; Mark R. Honard; Jeries I. Bishara, both of Mentor, Ohio; Joseph K. Walker, Jr., Beachwood, Ohio

[73] Assignee: ELTECH Systems Corporation, Boca Raton, Fla.

[21] Appl. No.: 467,157

[22] Filed: Feb. 16, 1983

[30] Foreign Application Priority Data

Feb. 18, 1982 [EP] European Pat. Off. ..... 82810076.8

[51] Int. Cl.[4] ..... H01M 4/88; C25B 11/00

[52] U.S. Cl. ..... 502/101; 204/290 F

[58] Field of Search ..... 204/290 R, 290 F; 252/425.3; 428/645; 502/101; 419/2, 8

[56] References Cited

U.S. PATENT DOCUMENTS 3,632,498 1/1972 Beer ..... 204/290 F 3,926,751 12/1975 De Nora et al. ..... 204/105 R 3,926,773 12/1975 Koziol et al. ..... 204/290 F

FOREIGN PATENT DOCUMENTS 46727 3/1982 European Pat. Off.

*Primary Examiner*—John F. Niebling

*Attorney, Agent, or Firm*—Arthur S. Collins

[57] ABSTRACT

An electrode having a lead base and a catalyst is manufactured by (a) compressing titanium sponge particles so as to consolidate them to a coherent porous layer, (b) applying the catalyst to the titanium sponge particles, and (c) fixing the layer of consolidated sponge particles to the lead base. The catalyst is formed on the titanium sponge particles before or after their consolidation to a coherent layer. This layer may be produced and fixed to the base in a single compressing and fixing step combining (a) and (c). Oxygen is anodically evolved at a reduced, stable potential by means of this electrode, so that it can be usefully applied as an anode in processes for electrowinning metals from acid electrolytes.

7 Claims, No Drawings

MANUFACTURE OF ELECTRODES WITH LEAD BASE

TECHNICAL FIELD

The present invention relates to the manufacture of dimensionally stable electrodes which comprise a base of lead or lead alloy and a catalyst for carrying out an electrochemical reaction.

BACKGROUND ART

Lead or lead alloy anodes have been widely used in processes for electrowinning metals from sulphate solutions. They nevertheless have important limitations, such as a high oxygen overvoltage and loss of the anode material leading to contamination of the electrolyte as well as the metal product obtained on the cathode.

Anodes of lead-silver alloy provide a certain decrease of the oxygen overvoltage and improvement of the current efficiency, but they still have the said limitations as a whole.

It has been proposed to use dimensionally stable titanium anodes with a platinum metal oxide coating for anodic evolution of oxygen, but such anodes are generally subject to more or less rapid passivation and oxidation of the titanium base.

It has also been proposed to provide the titanium base with a protective undercoating comprising a platinum group metal beneath the outer coating, but they generally do not provide sufficient protection to justify the high cost of using precious metals.

Metal electrowinning cells generally require a large anode surface in order to ensure an even electrodeposition on the cathode, so that the cost of using a titanium base must also be taken into account.

Dimensionally stable anodes with mixed oxide coatings comprising platinum group metals and valve metals are described in U.S. Pat. 3 632 498. An example of this patent relates to the preparation of a fine Ti-Pd mixed oxide power which is then applied by rolling or hammering into a rod of soft-quality titanium. However, the amount of precious metal incorporated in the mixed oxide powder and applied to the electrode in this manner could be prohibitive for various industrial applications. Thus, when the electrode surface is to be substantially covered with the mixed oxide powder, and more particularly when the electrode is intended for operation at a relatively low current density such as is used in metal electrowinning, the cost of precious metal thus applied in the form of a mixed oxide may be especially prohibitive.

DISCLOSURE OF THE INVENTION

An object of the invention is to provide a simple process for manufacturing electrodes with a lead base.

Another object of the invention is to provide an anode with a base of lead or lead alloy with improved electrochemical performance for anodically evolving oxygen in an acid electrolyte, so as to be able to substantially avoid loss of the anode material, whereby to avoid said limitations of conventional lead or lead alloy anodes.

A further object of the invention is to provide a simple method of making such an anode with improved performance.

These objects are essentially met by the invention as set forth in the claims.

The electrochemical performance of the electrode is improved in accordance with the invention by providing the electrode base of lead or lead alloy with a coherent porous layer of catalytically activated titanium sponge which is firmly anchored and electrically connected to the base.

Said coherent activated titanium sponge layer is advantageously arranged according to the invention, so as to substantially cover the entire surface of the lead or lead alloy base, and to thereby present a large reaction surface, with a substantially uniform distribution of the current density, while protecting the underlying lead base.

The catlyst arranged on a lead or lead alloy base in accordance with the invention may advantageously consist of any suitable metal of the platinum group, either in the form of an oxide or in metallic form. Iridium, ruthenium, platinum, palladium and rhodium may be advantageously used to provide an oxygen evolution catalyst applied to titanium sponge in accordance with the invention.

The use of titanium sponge particles according to the invention allows the irregularly shaped porous sponge particles to be readily consolidated by compression, which leads to thier deformation and entanglement with adjacent particles.

The catalytic particles applied according to the invention may have a size lying in the range between 75 and 1250 microns, and preferably in the range of about 150–600 microns.

The amount of titanium sponge applied according to the invention per unit area of the anode base will preferably lie in the range between about 300 $g/m^2$ and about 2000 $g/m^2$.

A very small amount of catalyst may be evenly applied in accordance with the invention on a very large surface comprising a very small proportion of said catalyst, which may advantageously correspond to 0.3% by weight of the titanium sponge. A minimum amount of said catalyst may thus be evenly distributed on a very large surface, thus ensuring particularly effective and economical use of the catalyst. On the other hand, considerably higher proportions of catalyst than are indicated above may be used where inexpensive catalysts are used. As may be seen from the examples further below, the method according to the invention as set forth in the claims allows platinum group metal compounds to be very simple applied to titanium sponge and thermally decomposed so as to convert them to a suitable catalyst.

According to one embodiment of the invention the sponge can be first consolidated to a porous layer which is then activated and finally fixed to the base. The titanium sponge particles may likewise be consolidated to a layer which is simultaneously fixed to the lead base by applying pressure, while catalytic activation may be subsequently effected on the consolidated layer fixed to the base, at a temperature at which the lead or lead alloy base will not undergo significant melting.

It has moreover been found that the simultaneous application of heat and pressure to the titanium sponge can be advantageous with regard to fixation of said layer on the lead base.

The following examples illustrate various modes of carrying out the invention.

EXAMPLE 1

2.8 g of titanium sponge having a particle size ranging from 315 to 630 microns is uniformly distributed in a die of 6.5×2.5 cm and pressed with a pressure of 320 kg/cm$^2$.

The resulting porous titanium body has a thickness of 0.65 mm and a calculated porosity of 40%.

This porous body is activated by impregnation with a solution containing:

0.54 g $RuCl_3.H_2O$, 1.8 g butyltitanate, 0.25 ml of HCl, 3.75 ml of butylalcohol.

After impregnation, the porous body is dried by heating in air at 120° C. for 15 min., baked at 420° C. in an air flow for 15 min., followed by natural cooling. These impregnating, drying, baking and cooling steps are repeated 3 times. This results in a porous body activated by $RuO_2$—$TiO_2$ with a loading of Ru and Ti amounting to 20 and 22 g/m$^2$ respectively, loading based on the projected surface area (16 cm$^2$) of the upper face of porous body.

The activated porous body is then pressed onto a 3 mm thick lead coupon of the same cross-sectional size by applying a pressure of 250 kg/cm$^2$. The resulting electrode made from a porous body firmly bonded to a lead substrate is being tested as an oxygen evolving anode in a 150 gpl $H_2SO_4$ solution at room temperature at a current density of 500 A/m$^2$ and exhibits a low, stable oxygen half-cell potential of 1.63 V (vs NHE) after 103 days of test operation.

EXAMPLE 2

An electrode was prepared in exactly the same manner as described in Example 1, except that the particle size of the Ti sponge amounted to 630–1250 microns. When tested as in Example 1, the potential amounted to 1.68 V (vs NHE) after 96 days of operation.

EXAMPLE 3

An electrode was prepared in the same manner as described in Example, 1, except that a lead calcium alloy (0.06% Ca) was used instead of pure lead as the substrate material. When tested as in Example 1, the potential amounted to 1.70 V (vs NHE) when the test was interrupted after 4000 hours.

EXAMPLE 4

3.25 g of titanium sponge having a particle size ranging from 40 to 20 mesh was pressed in a 16 cm$^2$ die with a pressure of 375 kg/cm$^2$. The resulting porous titanium body is activated by impregnation with a solution containing: $0.54RuCl_3.H_2O$ (38% Ru); $0.12PdCl_2$; 1.84 butyltitanate; 3.75 ml of butylalcohol.

After impregnation, the porous body is dried by heating in air at 140° C. for 15 minutes and baked at 450° C. for 15 minutes. These impregnating, drying, baking and cooling steps are repeated three times. This results in a porous body activated with $RuO_2$—PdO—$TiO_2$ catalytic mixture with a loading of Ru, Pd and Ti of respectively 20, 7 and 25 g/m$^2$ (based on projected surface area).

The activated porous body is then pressed onto a lead plate and tested as described in Example 1. It is still in operation after 250 days at 1.8 V vs. NHE.

As may be seen from the above examples, an anode according to the invention can be fabricated in a simple manner and be used for prolonged evolution of oxygen at a potential which is significantly lower than the anode potential corresponding to oxygen evolution on lead or lead alloy under otherwise similar operation conditions.

The invention provides various advantages of which the following may be mentioned for example:

(a) An anode made according to the invention can be operated at a significantly reduced potential, well below that of conventional anodes of lead or lead alloy currently used in industrial cells for electrowinning metals from acid solutions. The cell voltage and hence the energy costs for electrowinning metals may thus be decreased accordingly.

(b) Contamination of the electrolyte and the cathodic deposit by materials coming from the anode can be substantially avoided, since it has been experimentally established that oxygen is evolved on the catalytic particles at a reduced potential, such that the lead or lead alloy of the anode base is effectively protected from corrosion.

(c) Dendrite formation on the cathode may lead to short circuits with the anode and can thereby burn holes into the anode, but this will nevertheless lead to no serious deterioration of the performance of the anode according to the invention, since it operates with oxygen evolution on the catalytic particles at a reduced potential, at which any part of the lead or lead base which is exposed does not conduct current to the electrolyte, and hence does not undergo notable corrosion.

(d) Conventional lead or lead alloy anodes may be readily converted into improved anodes according to the invention and it thus becomes possible to retrofit industrial cells for electrowinning metals in a particularly simple and inexpensive manner to provide improved performance.

(e) The reduced cell voltage obtained with anodes according to the invention can be readily monitored so as to be able to rapidly detect any notable rise which may occur in the anode potential. The catalytic particles on the lead or lead alloy base may thus be readily either reactivated or replaced whenever this should become necessary.

(f) Platinum group metals can be used as catalysts in an extremely economical manner, by combining them in a very small proportion (e.g. 0.3–2.0%) with titanium sponge applied in a many times larger amount to the anode base of lead or lead alloy. The cost of precious metal may thus be justified by the resulting improvement in anode performance.

(g) Platinum group metals may thus be used in very restricted amounts, and combined with less expensive stable materials.

(h) Other catalysts for oxygen evolution, obtained from non-noble metals, such as e.g. manganese dioxide, may likewise be applied to the titanium sponge according to the invention.

(i) Titanium sponge is much less expensive than titanium processed into sheets or grids, and may likewise be applied economically.

(j) Various types of catalyst can be uniformly applied in a simple, reproducible and economical manner.

INDUSTRIAL APPLICABILITY

Anodes according to the invention may be advantageously applied instead of currently used anodes of lead or lead alloy, in order to reduce the energy costs required for electrowinning metals such as zinc, copper, and cobalt industrially, and to improve the purity of the metal produced on the cathode.

Such anodes may be usefully applied to various processes where oxygen evolution at a reduces overvoltage is required.

The process of the invention may likewise be usefully applied to manufacture anode or cathodes for carrying out any desired electrochemical process under conditions where the lead base is essentially inert.

We claim:

1. A process for the manufacture of a catalytic, lead electrode having an inactive base of lead or lead alloy and an active catalyst thereon, comprising;

(a) producing a preformed, flat, coherent, porous body of consolidated titanium sponge by compacting assembled, irregularly shaped, porous particles of titanium sponge into such a body of substantially uniform thickness;

(b) impregnating said preformed body from step (a) with a solution containing a precursor of said active catalyst, and heat treating the impregnated body to convert the precursor to said catalyst; and (c) pressing the active catalyst containing, preformed body produced in step (b) onto a base of lead or lead alloy, thereby fixing and firmly anchoring said body to said base.

2. The process of claim 1 wherein said particles of titanium sponge are predominantly in the size range between 75 and 1250 microns.

3. The process of claim 1 wherein said active catalyst comprises a platinum group metal or oxide of such a metal.

4. The process of claim 1 wherein said particles compacted in step (a) thereof are arranged in a mass amounting to between 300 and 2000 grams per square meter of area covered.

5. The process of claim 1 wherein the active catalyst formed in step (b) comprises a combination of at least one platinum group metal oxide with an oxide of titanium.

6. The process of claim 5, characterized in that said catalyst comprises ruthenium and titanium in oxide form.

7. The process of claim 5, characterized in that said catalyst comprises ruthenium, palladium and titanium in oxide form.

* * * * *